US005941490A

United States Patent [19]

Pearse

[11] Patent Number: 5,941,490

[45] Date of Patent: Aug. 24, 1999

[54] HOLDER FOR MUSICAL INSTRUMENT, OR THE LIKE

[75] Inventor: John Pearse, New Tripoli, Pa.

[73] Assignee: Breezy Ridge Instruments, Ltd., Center Valley, Pa.

[21] Appl. No.: 08/861,796

[22] Filed: May 22, 1997

[51] Int. Cl.[6] ..... A47H 1/16

[52] U.S. Cl. ..... 248/302

[58] Field of Search ..... 248/302, 304, 248/303, 110, 112, 215, 301, 534, 538; 84/267

[56] References Cited

U.S. PATENT DOCUMENTS

| | | | |
|---|---|---|---|
| 637,208 | 11/1899 | Hughes et al. | 211/66 |
| 785,381 | 3/1905 | Robin | 248/303 |
| 894,197 | 7/1908 | Fleming | 248/302 |
| 1,049,971 | 1/1913 | Appleby | 248/303 |
| 1,967,427 | 7/1934 | Puckett | 248/302 |
| 2,284,452 | 5/1942 | Simons | 211/65 |
| 2,517,244 | 8/1950 | Rundell | 248/310 |
| 2,764,384 | 9/1956 | Kirsch | 248/305 |
| 3,220,682 | 11/1965 | Hannon | 248/211 |
| 4,078,753 | 3/1978 | Cole | 248/302 |
| 4,269,381 | 5/1981 | Harms | 248/222.2 |
| 4,832,338 | 5/1989 | Magazzi | 273/32 A |
| 4,938,446 | 7/1990 | Williams | 248/530 |
| 5,035,386 | 7/1991 | Tucker | 248/110 |
| 5,476,240 | 12/1995 | McDonough | 248/213.2 |
| 5,609,318 | 3/1997 | Scheh | 248/311.2 |

*Primary Examiner*—Ramon O. Ramirez
*Assistant Examiner*—Anita M. King
*Attorney, Agent, or Firm*—Synnestvedt & Lechner LLP

[57] ABSTRACT

A holder for supporting a musical instrument, or the like, such as a guitar, or the like, when the instrument is not in use by the owner thereof is disclosed. The holder has three points of impingement, one on the front of the instrument, a second on the rear of the instrument, this one being generally V-shaped and the third one being on a support means such as a shelf, the three points of impingement being interconnected.

8 Claims, 4 Drawing Sheets

HOLDER FOR MUSICAL INSTRUMENT, OR THE LIKE

This invention relates to a holder for supporting a musical instrument, such as a guitar, or the like, when the instrument is not in use by the owner thereof.

BACKGROUND OF THE INVENTION

There has long been a need well known to musicians for a means of readily and simply supporting their instruments during break periods, or between songs, or when the musician is using an alternative instrument, or during a period when the musical score does not call for the particular instrument in question to play. Many relatively clumsy devices are available which are in the nature of stands resting on the floor but these are apt to get in the way of the musicians moving around from place to place, they are clumsy, and they are sometimes difficult to transport so as to be readily available at any location.

SUMMARY OF THE INVENTION

The invention herein disclosed comprises a holder which is small and compact and easy to transport in a coat pocket, or in the spare string compartment of an ordinary guitar case, or in a briefcase or handbag.

The invention is convenient and easy and inexpensive to manufacture from ordinary materials such as metal bar stock, or heavy wire. The holder of the invention can be used in any location. It is simply removed from its carrying means and placed on a convenient supporting surface while the guitar, or other instrument, or other object having a neck-like portion, is held at an angle to insert it between the upper and lower members which grip the instrument neck in the front and in the rear thereof providing a firm grip on the instrument and then the leg provided on the holder is placed on the support surface. Conveniently available support surfaces include a music stand, the edge of a speaker box, or the top edge of a door or frame thereof. The holder of the invention needs only a ledge or shelf or protrusion, approximately ¼"–½" wide, in order to give it purchase to hold a guitar.

If the support surface is associated with a wall or the vertical side of a speaker cabinet or the like, in other words, a vertical surface providing for limiting the travel of the lower end of the guitar when it is in position to be left in the grip of the holder, the guitar is placed in the holder and the holder placed on the support surface with the bottom of the back of the base of the guitar resting against the wall, etc.

When a support surface is used which has no vertical flat surface extending therebelow to the floor, such as a music stand, or the like, the base of the guitar, or other instrument, will simply swing backward until an equilibrium position is reached upon which the guitar will attain a stable, suspended position where it will stay until needed.

In the preferred embodiment, the guitar neck is placed in between a V-shaped member, impinging on the back of the neck with the guitar neck cradled in the V, and a lower member impinging on the front of the neck. This provides essentially a three-point retaining system (a fourth point of contact possibly being present if the supporting surface is close to a wall or the like so that, as above mentioned, the base of the guitar rests against the lower part of the wall).

Briefly, the invention comprises a first member which impinges against the front of the neck-like portion of an object to be supported on a support means, such as a guitar, or broom, or the like, at a first point of impingement. There is a second member which impinges against the rear of the neck-like portion of the object at a second point of impingement above the first point of impingement. A third member impinges against the support means at a third point of impingement, and the invention provides means for interconnecting the first, second and third members so that the weight of the object creates a moment in a given direction about a pivot point on said support means at the third point of impingement and the support means, by means of the impingement of the third member, creates a moment about said pivot point in the opposite direction, the moments being equal and opposite when the holder and the object being held assume a given position in which the object being held is suspended in a stable position supported by and to one side of the support means pivot point when in said given position.

To protect the guitar and the supporting surface and to provide for frictional engagement between the members of the invention and the guitar neck and supporting surface, a soft coating such as a plasticized skin of synthetic resin may be provided where the impingement with the front and back of the guitar and with the support surface occurs.

DETAILED DESCRIPTION OF THE PREFERRED EMBODIMENT

Figure 1:
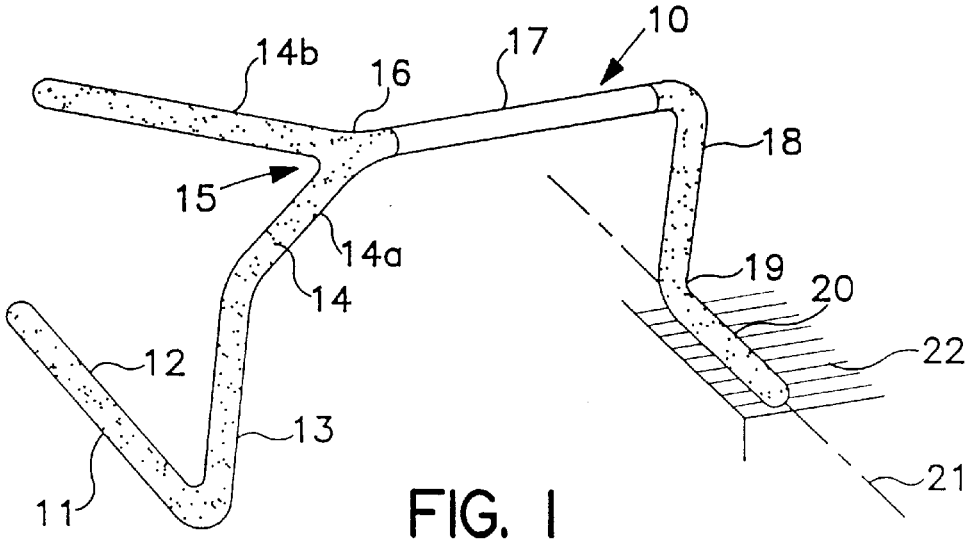
FIG. 1 is a perspective view of the holder of the invention.

In FIG. 1, the holder 10 of the invention comprises a first member 11 oriented essentially horizontally and designed to impinge against the front of a guitar neck, or the like, the guitar neck impinging against the surface 12. The member 11 may conveniently be made of metal bar stock.

There is a second run of the bar stock, or the like, 13 extending from an end of the member 11 substantially vertically upwardly and connecting with a V-shaped member 14, of the same bar stock, designed to cradle the neck of the guitar in the V of the V-shaped member, said V being indicated in general at 15. From the point 16 of the V, a bar stock member 17 extends rearwardly to a point of connection with a fifth bar stock member 18 which, in this embodiment, extends substantially vertically downwardly to the connection point 19 with a run of bar stock 20 oriented horizontally and intended to rest on the support surface.

The axis of the member 20 is the pivot point about which the moments which govern the action of the invention are applied, the axis being indicated by the dot-and-dash line 21.

With the guitar nested in the V of member 14 and impinging against the back of member 11, the weight of the guitar and holder generate a moment in counterclockwise direction as viewed in FIG. 1 which is equal and opposite to a moment in clockwise direction as viewed in FIG. 1 generated by the impingement of member 20 on the support surface (indicated at 22).

As indicated by the darker color, members 11, 13, 14 and 20 are coated with a soft, gummy-like plasticized resin surface, said members being those that include points of impingement with the object being supported and with the support surface 22.

The legs 14*a* and 14*b* of the V-shaped member 14 can be configured in a generally U-shape, rather than a V-shape, with essentially the same result, although the V-shape is preferred.

Figure 2:
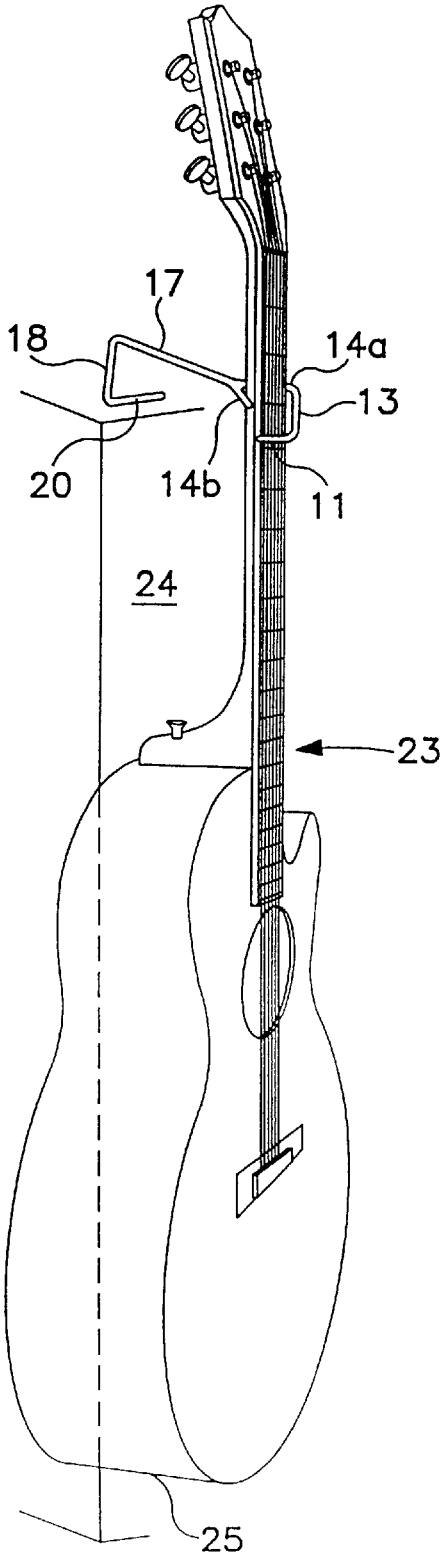
FIG. 2 is a view of the holder of the invention while holding a guitar on the edge of a speaker cabinet or the like, in a position where there is a vertical surface, below the support surface, against which the base of the guitar rests.

In FIG. 2, the invention is shown supporting a guitar generally indicated at 23 from a support surface such as a speaker cabinet 24, or the like. Note that, in this positioning of the holder and the guitar, the bottom edge 25 of the rear of the guitar impinges against the front of the speaker cabinet, thus limiting the travel of the guitar in clockwise direction and creating a moment in counterclockwise direction which supplements the moment created by the impingement of the member 20 against the support means 24, these two moments being in clockwise direction are countered and balanced by the moment generated by the weight of the guitar and holder in counterclockwise direction, the moments being taken about a pivot point along the axis of the member 20 (as shown at 21 in FIG. 1).

Figure 3:
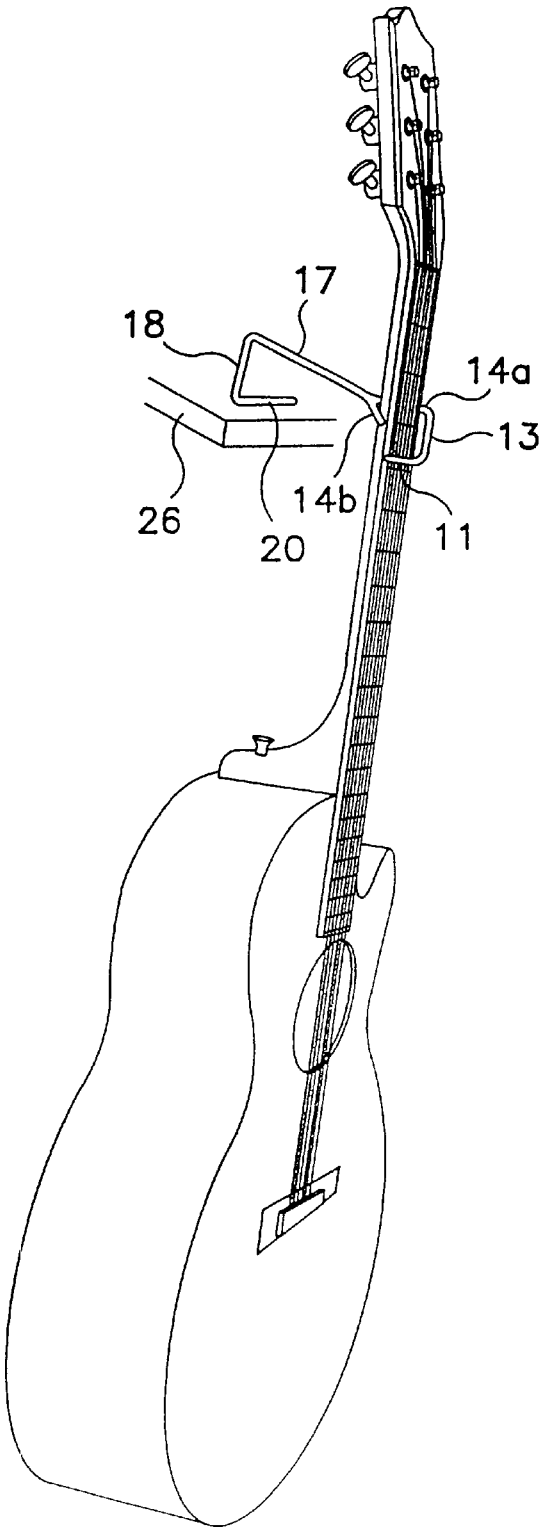
FIG. 3 is a view similar to FIG. 2 but showing the holder of the invention resting on a shelf or music stand or the like, not having a vertical surface therebelow, and it will be seen that the guitar has swung backwardly, as compared to FIG. 2, to a position of balance.

In FIG. 3, a guitar is supported by a holder according to the invention from a shelf 26, or the like, which has no vertical surface extending downwardly therefrom. It will be seen that in FIG. 3, the guitar has rotated slightly, as compared with FIG. 2, with the bottom swinging inwardly to a position underneath the shelf 26 where the moments generated are equal and opposite when the guitar is at rest, supported from the shelf 26. There is no point of impingement of the base or bottom of the guitar but it simply hangs in mid-air, although safe and secure in the holder of the invention.

Figure 4:
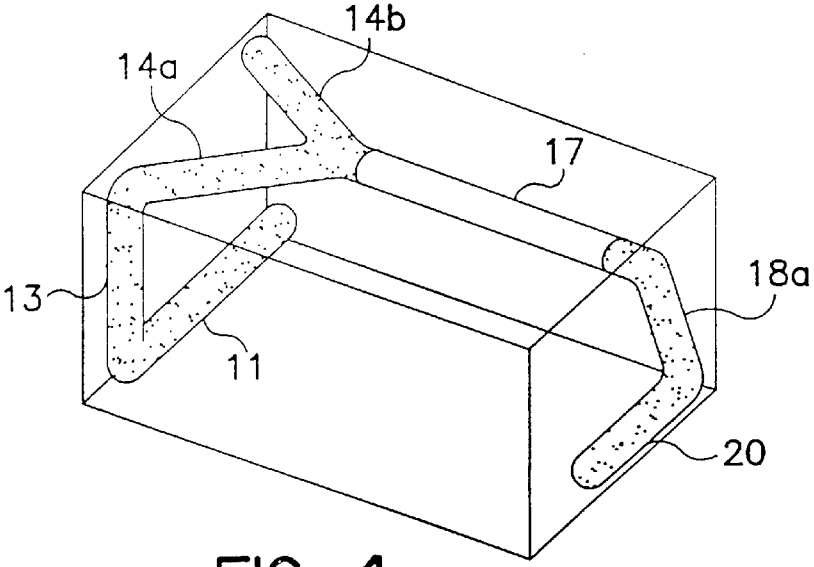
FIG. 4 is a perspective elevational view of an alternative embodiment.

FIG. 4 shows a modified embodiment according to which the member marked 18*a* replaces the member 18 in FIG. 1 and is angled from the vertical so as to orient the sixth run of bar stock 20 in line with and centered on the first run of bar stock.

Figure 5:
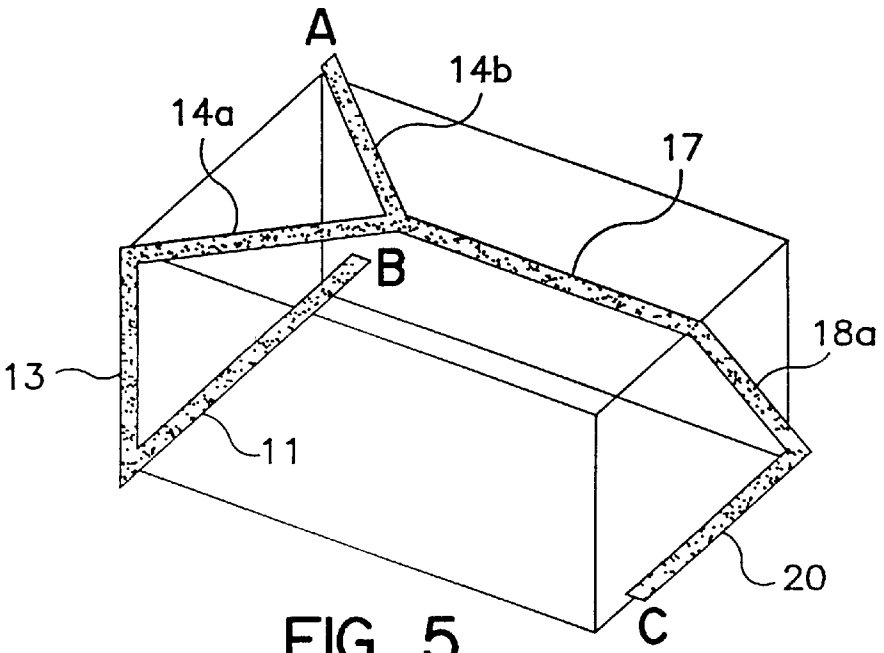
FIG. 5 is a view of an idealized rendition of the invention, being the embodiment shown in FIG. 4.

FIG. 5 shows an idealized version of the embodiment of FIG. 4, both figures indicating construction lines constituting a parallelepiped within which the holder of the invention fits.

The invention is conveniently formed of metal, preferably steel, in the form of round bar stock approximately ¼" in diameter. Heavy wire and other materials would serve the purpose provided they have the strength and stiffness necessary to support the weight of a guitar securely and safely.

The portions of the holder which are shown dark, in FIG. 1, are coated with a special coating, preferably a soft plasticized skin which, by virtue of its surface drag characteristic, imparts a secure grip to the object being held, and a secure grip on the support surface.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A holder for supporting on a support a musical instrument having a neck, the holder being formed of metal bar stock having a surface and comprising a substantially horizontal first run of the bar stock adapted to impinge on the front of the neck of the instrument at a first region of impingement of the bar stock on said instrument, a substantially vertical second run of the bar stock having an upper end and extending upwardly from an end of the first run, a third run of bar stock comprising two legs of bar stock coming together to form a V-shape and being secured at an end of one of said legs of the V-shape to the upper end of the second run of bar stock in position to dispose the V-shape so that it may straddle and impinge on the rear of the neck of said instrument, at a second region of impingement of the bar stock on said instrument above said first region of impingement on said instrument, with the neck of the instrument being adapted to be cradled in the V-shape, a substantially horizontal fourth run of bar stock extending from the coming together of the two legs of the V-shape rearwardly and generally perpendicular to said first run, a fifth run of bar stock extending downwardly from an end of the fourth run opposite to the V-shape, and a substantially horizontal sixth run of bar stock extending substantially parallel to said first run, and constructed and arranged so that it can rest on the support, whereby to arrest the gravitational fall of the instrument.

2. The holder according to claim 1 in which the surface of the bar stock in the first and second regions of impingement of the bar stock is coated with a coating of a relatively soft material and the said sixth run of bar stock includes an area also coated with said relatively soft material in the position where the said sixth run of bar stock rests against the support.

3. The holder according to claim 1 in which the fifth run of bar stock is substantially vertical.

4. The holder according to claim 1 in which the fifth run of bar stock is angled from the vertical so as to orient the sixth run of bar stock in horizontal alignment with and centered on the first run of bar stock.

5. A holder for supporting on a support elevated above the floor an object having an elongate neck-like portion, said holder having a surface and comprising a first member which is adapted to impinge against the front of the neck-like portion of the object at a first region of impingement of the holder on said object, a second member which is adapted to impinge against the rear of the neck-like portion of the object at a second region of impingement of the holder on said object above the first region of impingement, a third member adapted to impinge against said support at a third region of impingement, and means interconnecting the first, second and third members so that the weight of said object being adapted to be supported creates a moment in a given direction about a pivot point along the axis of the third member, and, the impingement of said third member, creates a moment is created about said pivot point in the opposite direction, said moments being equal and opposite when said holder and the object being supported assume a given position, resulting in the object being adapted to be supported in stable position when in said given position.

6. The holder according to claim 5 in which a limiting surface limits the travel of said holder and the object being supported in said opposite direction, whereby to create a supplemental moment in said opposite direction to assist in equalizing the moments, with said holder and the object being supported being biased in said opposite direction toward said limiting surface.

7. The holder according to claim 5 in which the second member is a V-shape and with the neck of the object being adapted to be supported in the V-shape.

8. The holder according to claim 7 in which material composing the surface of the holder in proximity to said first, second and third regions of impingement comprises a relatively soft material.

* * * * *